US006015029A

United States Patent [19]

Maxwell

[11] Patent Number: 6,015,029

[45] Date of Patent: Jan. 18, 2000

[54] METHOD AND APPARATUS FOR TRANSMISSION DRAIN INSTALLATION

[76] Inventor: Mark A. Maxwell, 2224 Noble Ct. SE. #C, Auburn, Wash. 98092

[21] Appl. No.: 09/130,033

[22] Filed: Aug. 4, 1998

[51] Int. Cl.[7] ..... F16N 31/00

[52] U.S. Cl. ..... 184/106; 184/1.5

[58] Field of Search ..... 184/1.5, 105.3, 184/106; 72/414, 454

[56] References Cited

U.S. PATENT DOCUMENTS

| | | | |
|---|---|---|---|
| 481,998 | 9/1892 | Baum | 74/454 |
| 1,464,501 | 8/1923 | Engel | 72/454 |
| 1,528,095 | 3/1925 | Bredar . | |
| 1,539,914 | 6/1925 | Rhoades . | |
| 1,729,978 | 10/1929 | Barron . | |
| 2,703,129 | 3/1955 | Smith | 153/53 |
| 2,917,956 | 12/1959 | Merion | 81/15 |
| 3,720,287 | 3/1973 | Martel | 184/1.5 |
| 4,134,380 | 1/1979 | Niwa et al. | 184/1.5 |
| 4,359,023 | 11/1982 | Persson | 184/106 |
| 4,674,314 | 6/1987 | McGregor, Jr. | 74/414 |
| 4,745,894 | 5/1988 | Laipply et al. | 184/1.5 |
| 4,761,987 | 8/1988 | Gamauf | 72/454 |
| 4,776,430 | 10/1988 | Rule | 184/1.5 |
| 5,181,487 | 1/1993 | Rodabaugh | 184/106 |
| 5,259,588 | 11/1993 | Crosby, Jr. et al. | 184/1.5 |
| 5,285,824 | 2/1994 | Krstovic | 141/1 |
| 5,291,968 | 3/1994 | Brown | 184/1.5 |
| 5,318,080 | 6/1994 | Viken | 141/98 |
| 5,368,181 | 11/1994 | Myers | 184/1.5 |
| 5,465,692 | 11/1995 | Uraki et al. | 184/106 |
| 5,467,746 | 11/1995 | Waelput et al. | 184/1.5 |
| 5,794,484 | 8/1998 | Jaddou | 74/414 |
| 5,881,841 | 3/1999 | Mason | 184/1.5 |

*Primary Examiner*—David A. Bucci
*Assistant Examiner*—Chong H. Kim
*Attorney, Agent, or Firm*—David S. Thompson

[57] ABSTRACT

An apparatus for installation of a transmission fluid pan drain provides upper and lower deformation plates attachable to opposed sides of the transmission fluid pan by a threaded stud. The upper and lower deformation plates are sized and shaped so that when torque is applied to nuts carried on the threaded stud the plates are forced together, thereby deforming the transmission fluid pan, causing a depression or dimple in the fluid pan. After removing the deformation plates and stud, a hollow bolt is attachable in a fluid-tight manner to the transmission fluid pan in a manner wherein an upper end is carried above the pan and a lower threaded end is carried below the pan. An end cap is attachable to the threaded lower end of the hollow bolt, allowing transmission fluid to be drained by removing the end cap.

1 Claim, 2 Drawing Sheets

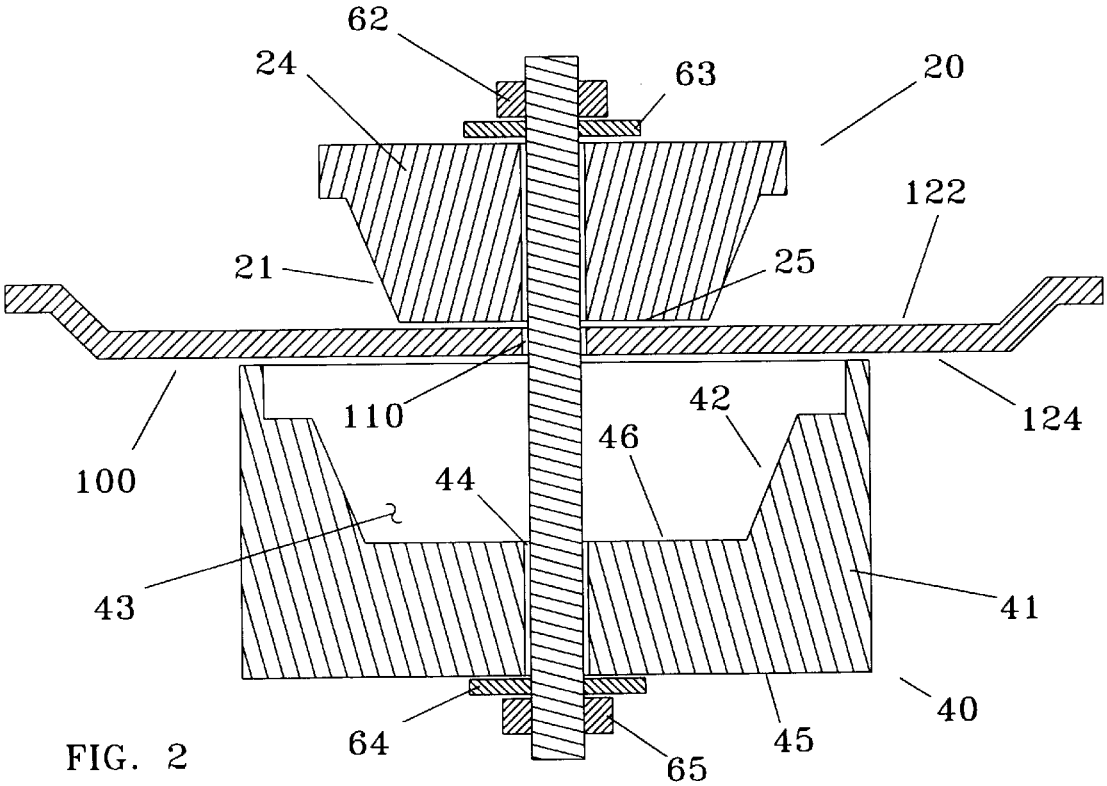
FIG. 2
FIG. 3
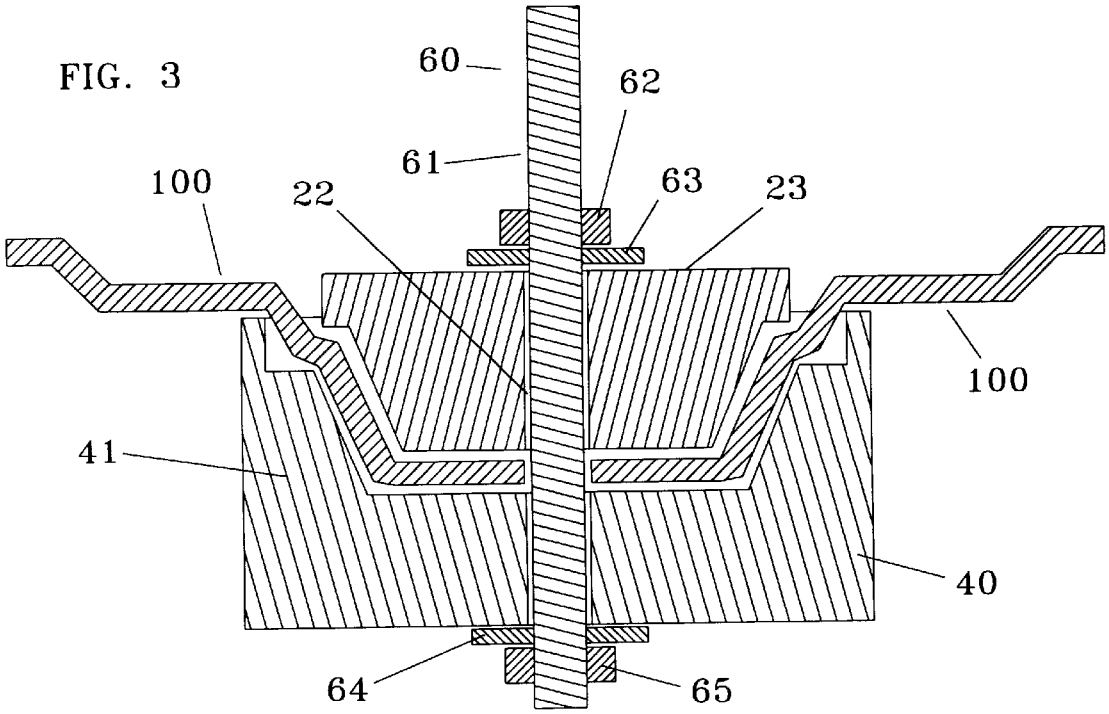

METHOD AND APPARATUS FOR TRANSMISSION DRAIN INSTALLATION

CROSS-REFERENCES

There are no applications related to this application filed in this or any foreign country.

BACKGROUND

Removing the transmission fluid from vehicles of certain makes, models and model years can be quite difficult because of a lack of any type of drain device. In the absence of a drain, the standard method or removing the fluid is to loosen the bolts holding one side of the transmission pan, as seen in the figure labeled "prior art," and allow the transmission fluid to spill out in a somewhat uncontrolled manner.

The known method of draining fluid is therefore messy and inconvenient. It results in fluid flows and splashes that miss collection devices, such as pans or trays, and therefore can result in pollution hazards and clean up costs.

What is needed is an apparatus and method which converts existing transmission drain pans to provide a drain which is easily and inexpensively installed, and may be conveniently operated.

SUMMARY

The method and apparatus for transmission fluid pan drain installation of the present invention provides some or all of the following operational steps and associated structures.

(A) A hole is drilled in a transmission fluid pan to which a drain is to be attached.

(B) An upper deformation plate defining a lower surface having a modified convex configuration sized to form a depression in a transmission fluid pan is placed on an upper surface of the transmission pan. A bolt passageway through the upper deformation plate is positioned over the hole in the transmission pan.

(C) A lower deformation plate defining an upper surface having a modified concave configuration sized to substantially enclose the lower surface of the upper deformation plate is placed on a lower side of the transmission pan. A bolt passageway through the lower deformation plate is positioned under the hole in the transmission fluid pan.

(D) A threaded stud is passed through the bolt passageway in the upper deformation plate, the hole in the transmission fluid pan and through the bolt passageway in the lower deformation plate.

(E) Threaded nuts are attached to each end of the threaded stud, typically with appropriately sized washers.

(F) Torque is applied to one or both threaded nuts, causing the upper and lower deformation plates to be drawn together, thereby deforming the transmission fluid pan, which is bent to conform to the space between the upper and lower deformation plates.

(G) The deformation plates and threaded stud are then removed, revealing the deformed transmission fluid pan.

(H) A hollow bolt is then passed through the hole in the transmission fluid pan, into a position wherein an upper end of the hollow bolt is located above the upper side of the transmission fluid pan and a threaded lower end of the hollow bolt is located below the lower side of the transmission fluid pan.

(I) Upper and lower washers and nuts are placed on both sides of the hollow bolt, securing the hollow bolt to the transmission fluid pan in a fluid-tight manner.

(J) An end cap is attached to the threaded lower end of the hollow bolt, whereby the end cap may be removed, allowing transmission fluid drainage, or attached, allowing transmission fluid retention.

It is therefore a primary advantage of the present invention to provide a novel method and apparatus for transmission drain installation that allows existing transmission fluid pans to be retrofit with a new drain.

Another advantage of the present invention is to provide a kit of parts to support a novel method and apparatus for transmission drain installation, including all parts needed to allow convenient transmission fluid pan drain installation.

A still further advantage of the present invention is to provide a novel method and apparatus for transmission drain installation which creates a depression in the transmission fluid pan, causing fluid to flow into the depression, resulting in more complete transmission fluid removal and replacement.

DRAWINGS

These and other features, aspects, and advantages of the present invention will become better understood with regard to the following description, appended claims, and accompanying drawings where:

FIG. 2 is a cross-sectional view of the upper and lower deformation plates attached to the transmission fluid pan of FIG. 1.

FIG. 3 is a cross-sectional view of the upper and lower deformation plates and transmission fluid pan of FIG. 2, after torque applied to one or both nuts carried by the solid threaded stud has caused the upper and lower deformation plates to move together, thereby deforming the transmission fluid pan.

DESCRIPTION

Figure 7:
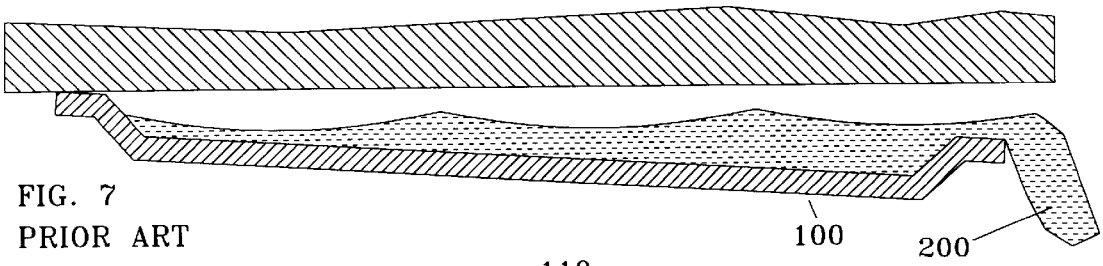
FIG. 7 PRIOR ART
FIG. 7 is a view of the prior art.

Referring generally to FIGS. 1 through 6, a transmission fluid pan drain constructed and installed in accordance with the principles of the invention is seen. The apparatus for transmission fluid pan drain installation provides upper and lower deformation plates 20, 40 attachable to opposed sides of the transmission fluid pan 100 by a threaded stud 60. The upper and lower deformation plates are sized and shaped so that when torque is applied to nuts carried on the threaded stud the plates are forced together, thereby deforming the transmission fluid pan, causing a depression or dimple in the fluid pan. After removing the deformation plates and stud, a hollow bolt 70 is attachable in a fluid-tight manner to the transmission fluid pan in a manner wherein an upper end is carried above the pan and a lower threaded end is carried below the pan. An end cap 80 is attachable to the threaded lower end of the hollow bolt, allowing transmission fluid to be drained by removing the end cap.

The upper deformation plate 20, when forced against the lower deformation plate 40, causes a depression 120 in the transmission fluid plate 100. Referring to the cross-sectional views of FIGS. 2 and 3, the structure and design of the upper deformation plate 20 may be understood. The upper deformation plate typically provides a solid body 24 which defines a modified lower convex surface 21 which sized to form a depression in a transmission fluid pan when an upper surface of the transmission pan makes contact with the lower convex surface. A flat area 25 results in a flat area 125 on the transmission fluid pan, which allows leak-proof installation of the hollow bolt 70. A bolt passage 22 is typically smooth sided, and defines a passage sized for a threaded stud 60 between the modified lower convex surface 21 and the upper surface 23.

Continuing to refer to FIGS. 2 and 3, the construction of the lower deformation plate 40 may be understood. The lower deformation plate includes a body 41 which defines an upper concave surface 42 which is sized and shaped to form a cavity 43 which substantially encloses the modified lower convex surface 21 of the upper deformation plate 20 and a portion of the transmission pan 100. A flat area 46 results in a flat area 125 on the transmission fluid pan, which allows leak-proof installation of the hollow bolt 70. A bolt passage 44 is typically smooth sided, and defines a passage sized for a threaded stud 60 between the modified lower concave surface 42 and the lower surface 45.

A solid stud 60 or bolt is typically made of steel and provides a threaded surface 61. As seen in FIG. 2, the length of the stud is sufficient to extend from a position above the upper surface 23 of the upper deformation plate to a position below the lower surface 45 of the lower deformation plate 40. As seen in FIGS. 2 and 3, an upper nut 62 and washer 63 are carried by the stud against the upper surface 23, and a similar lower washer 64 and nut 65 are carried against the lower surface 45.

Figure 1:
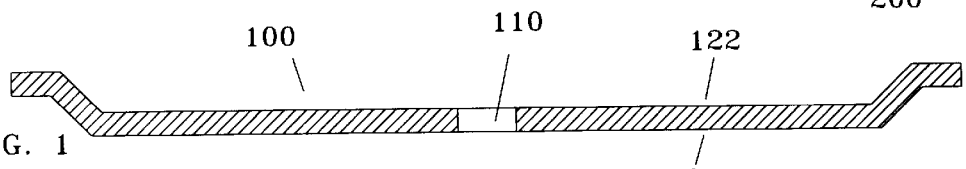
FIG. 1 is a cross-sectional view of a transmission fluid pan having a hold drilled through it.
Figure 4:
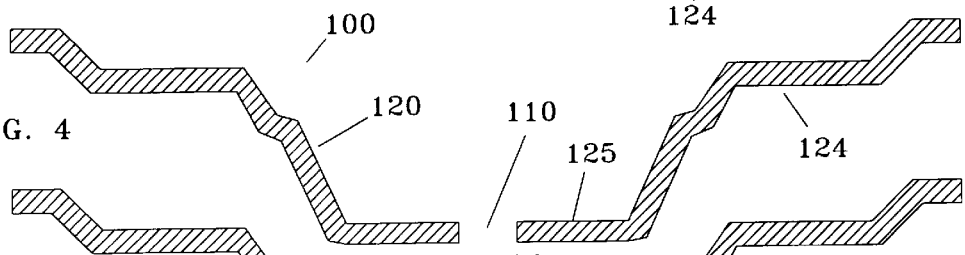
FIG. 4 is a cross-sectional view of the transmission fluid pan after the upper and lower deformation plates have been removed.

To form a depression 120 in a transmission fluid pan 100, a hole 110 sized for passage of the threaded stud 60 is first drilled in the transmission pan. The initial configuration of the pan, and the hole drilled are best seen in FIG. 1.

As seen in FIG. 2, the upper and lower deformation plates 20, 40 are then placed on opposite sides of the transmission fluid pan adjacent to the hole 110. The threaded stud 60 is passed through the smooth-sided bolt passageways 22, 44 of the upper and lower deformation plates 20, 40. Upper and lower washers and nuts 62–65 are attached.

Torque is applied to at least one of the nuts 62, 65, causing the distance between the nuts to decrease. As the distance between the nuts decreases, the distance between the deformation plates 20, 40 decreases. As this process takes place, the transmission fluid pan 100 is deformed, as the modified lower convex surface 21 of the upper deformation plate presses on the upper surface 122 of the transmission fluid pan, causing a depression 120 to form. A flat area 125 adjacent to the hole 110 in the transmission fluid pan allows the hollow bolt 70 to be installed in a leak-free manner.

When the depression is fully formed, as seen in FIG. 3, the lower surface 124 of the transmission fluid pan 100 is in contact with the modified upper concave surface 42 of the lower deformation plate. At this time the deformation plates and the threaded stud can be removed, revealing the deformed transmission fluid plate 100 seen in FIG. 4, having a fully formed depression 120 with a flat area 125.

Figure 5:
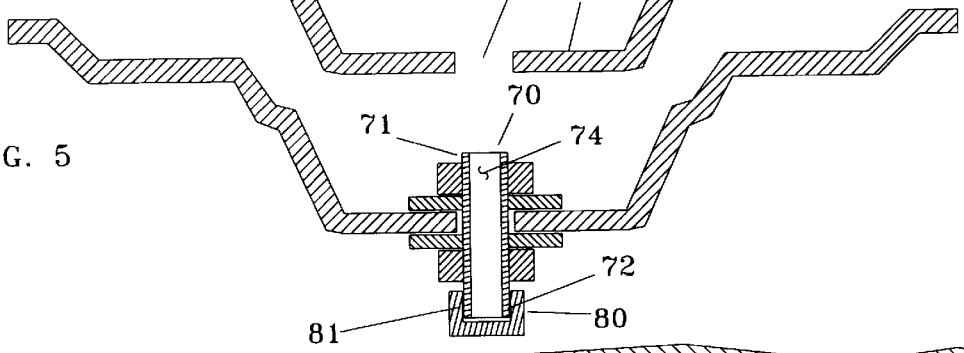
FIG. 5 is a cross-sectional view of the transmission fluid pan after installation of the hollow bolt secured by upper and lower washers and nuts, having the end cap installed.
Figure 6:
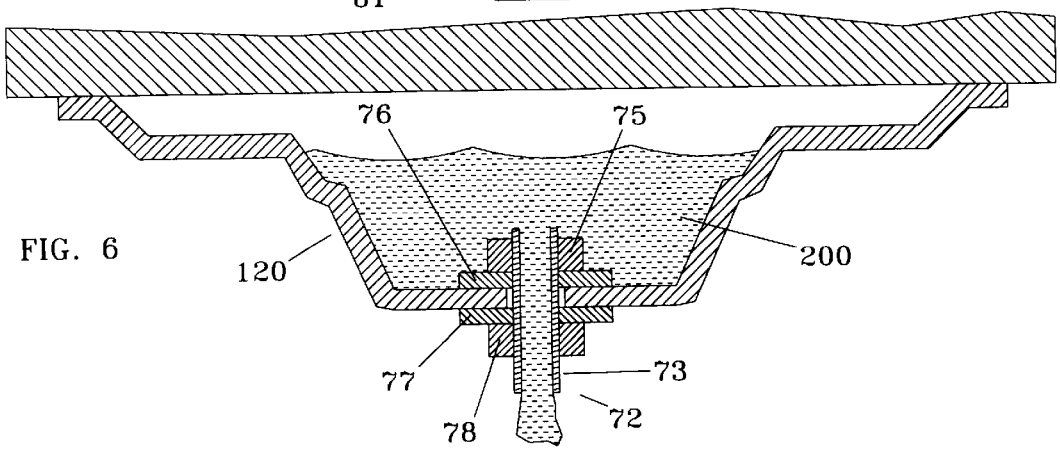
FIG. 6 is a cross-sectional view of the transmission fluid pan of FIG. 5, illustrating how the end cap can be removed to allow transmission fluid to drain.

As seen in FIG. 5, a hollow bolt 70 is passed through the hole 10 in the transmission fluid pan. Once positioned, an upper end 71 is carried above the upper surface 122 and a lower end 72 is carried below the lower surface 124. A threaded outside surface 73 carries an upper nut and washer 75, 76 and a lower nut and washer 77, 78. The nuts and washers 75–78 provide a fluid-tight seal, as seen in FIG. 6 against the flat area 125 of the depression 120.

An end cap 80 having a threaded inside surface 81 is removably attachable to the threaded surface 73 of the lower end 72 of the hollow bolt 70.

With the hollow bolt 70 and end cap 80 installed as seen in FIG. 5, the transmission may be filled with transmission fluid. When it is desired to drain the transmission fluid 200, the end cap 80 can be removed, as seen in FIG. 6, allowing the transmission fluid to drain into the depression 120 formed in the transmission fluid pan 100, from which it exits through the passageway 74 in the hollow bolt 70.

A preferred kit of parts includes upper and lower deformation plates 20, 40, a threaded stud 60 or bolt, nuts and washers 62–65, a hollow bolt 70, nuts and washers 75–78 and an end cap 80.

A reduced kit of parts includes upper and lower deformation plates 20, 40, a threaded stud 60 or bolt, a hollow bolt 70 and an end cap 80.

The previously described versions of the present invention have many advantages, including a primary advantage of providing a novel method and apparatus for transmission drain installation that allows existing transmission fluid pans to be retrofit with a new drain.

Another advantage of the present invention is to provide a kit of parts to support a novel method and apparatus for transmission drain installation, including all parts needed to allow convenient transmission fluid pan drain installation.

A still further advantage of the present invention is to provide a novel method and apparatus for transmission drain installation which creates a depression in the transmission fluid pan, causing fluid to flow into the depression, resulting in more complete transmission fluid removal and replacement.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, a variety of differently shaped upper and lower deformation plates could be used, provided that the shapes used result in a depression in the transmission fluid pan. References to "upper" or "lower" should be taken in the context of the drawings, and can in some cases be reversed. While the use of a threaded stud 60 is disclosed, a threaded bolt could be substituted, and should be considered equivalent. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method for installing a drain in a transmission fluid pan, 24 comprising:

(A) drilling a non-threaded hole in the transmission fluid pan;

(B) placing an upper deformation plate defining a lower surface having a modified convex configuration sized to form a depression in a transmission fluid pan on an upper surface of the transmission fluid pan, whereby a bolt passage through the upper deformation plate is positioned over the hole in the transmission pan;

(C) placing a lower deformation plate defining an upper surface having a modified concave configuration sized to substantially enclose the lower surface of the upper deformation plate on a lower side of the transmission pan, whereby a bolt passage through the lower deformation plate is positioned under the hole in the transmission fluid pan;

(D) passing a stud through the bolt passage in the upper deformation plate, the hole in the transmission fluid pan and through the bolt passage in the lower deformation plate;

(E) attaching nuts to each end of the threaded stud;

(F) applying torque to at least one of the nuts, whereby the upper and lower deformation plates are drawn together, thereby deforming the transmission fluid pan, which is bent to conform to the space between the upper and lower deformation plates;

(G) removing the deformation plates and threaded stud;

(H) passing a hollow bolt having a smooth interior passage, through the hole in the transmission fluid pan, and into a position wherein an upper end of the hollow bolt is located above the upper side of the transmission fluid pan and a threaded lower end of the hollow bolt is located below the lower side of the transmission fluid pan;

(I) fastening upper and lower washers and nuts on both sides of the hollow bolt, thereby securing the hollow bolt in position in a fluid-tight manner; and (J) attaching an internally threaded end cap to the threaded lower end of the hollow bolt, whereby the end cap may be removed, allowing transmission fluid drainage.

* * * * *